United States Patent [19]

Kliman et al.

[11] Patent Number: 4,984,181

[45] Date of Patent: Jan. 8, 1991

[54] METHOD OF SIMULATING BY COMPUTER THE APPEARANCE PROPERTIES OF A FABRIC

[75] Inventors: Harvey L. Kliman, Chadds Ford, Pa.; Royden H. Pike, Claymont, Del.

[73] Assignee: E. I. Du Pont de Nemours and Company, Wilmington, Del.

[21] Appl. No.: 273,068

[22] Filed: Nov. 18, 1988

Related U.S. Application Data

[63] Continuation-in-part of Ser. No. 874,476, Jun. 16, 1986, abandoned, which is a continuation-in-part of Ser. No. 724,599, Apr. 18, 1985, abandoned.

[51] Int. Cl.[5] ..... G06F 15/62

[52] U.S. Cl. ..... 364/518; 364/518; 73/159; 66/1 R; 340/703

[58] Field of Search ..... 364/468, 473, 570, 578, 364/518, 521, 522; 73/159, 160; 66/1 R; 340/703

[56] References Cited

U.S. PATENT DOCUMENTS 4,845,641 7/1989 Ninomiya et al. ..... 364/518

*Primary Examiner*—Gary V. Harkcom

*Assistant Examiner*—Phu K. Nguyen

[57] ABSTRACT

A direct printing technique for simulating the appearance streaks in fabrics includes the steps of obtaining a data set of yarn physical properties for each yarn in the fabric, programming a digital computer having graphics capability and pixel control of the graphics to average the yarn physical properties and calculating the pixel density from the individual yarn and yarn properties. The pixel density is then displayed as a series of rows of pixels wherein the number of pixels in each row is proportional to the individual yarn property of each yarn in the fabric. A simulation of the actual fabric appearance is obtained by just knowing the constituent yarn properties without having to make the actual fabric. Simulation parameters are confirmed by comparison of simulations with actual fabrics. Simulation parameters are confirmed by comparison of simulations with actual fabrics.

3 Claims, 7 Drawing Sheets

METHOD OF SIMULATING BY COMPUTER THE APPEARANCE PROPERTIES OF A FABRIC

This application is a continuation-in-part of application Ser. No. 874,476 filed June 16, 1986, now abandoned, which is in turn a continuation-in-part of copending application Ser. No. 724,599 filed Apr. 18, 1985 and now abandoned.

BACKGROUND OF THE INVENTION

The invention relates to simulating the appearance properties of a fabric based on properties of the yarn in the fabric based on physical and/or chemical properties of the yarn in the fabric. The simulation is comparable to the actual fabric formed from yarn of those properties and reveals wanted or unwanted patterning independent of color.

Both yarn manufacturers and fabric producers are faced with the problem of variations in yarn properties (e.g. denier, bulk, shrinkage, cross section, dyeability) and the effect of these variations on fabrics. In the past the effects of these variations in the actual fabric could only be determined by actually making test fabrics from the yarns which is expensive and time consuming.

SUMMARY OF THE INVENTION

The present invention provides a method for simulating actual fabric appearance by just knowing the constituent yarn properties without having to make the actual fabric. The method comprises the steps of obtaining a data set of yarn physical and/or chemical properties for each yarn in the fabric then programming a digital computer to average the yarn physical properties for each yarn in the fabric according to the construction of the fabric to produce an average property for each path in the fabric. The pixel density for the graphics display equipment associated with the computer is then calculated from the average yarn path properties and displayed to represent each yarn path in the fabric. This method can be used to simulate knit, woven, and carpet fabrics as demonstrated herein. The resulting simulation quantitatively represents gray scale patterning of fabrics independent of color.

DETAILED DESCRIPTION OF THE PREFERRED EMBODIMENT

Figure 1:
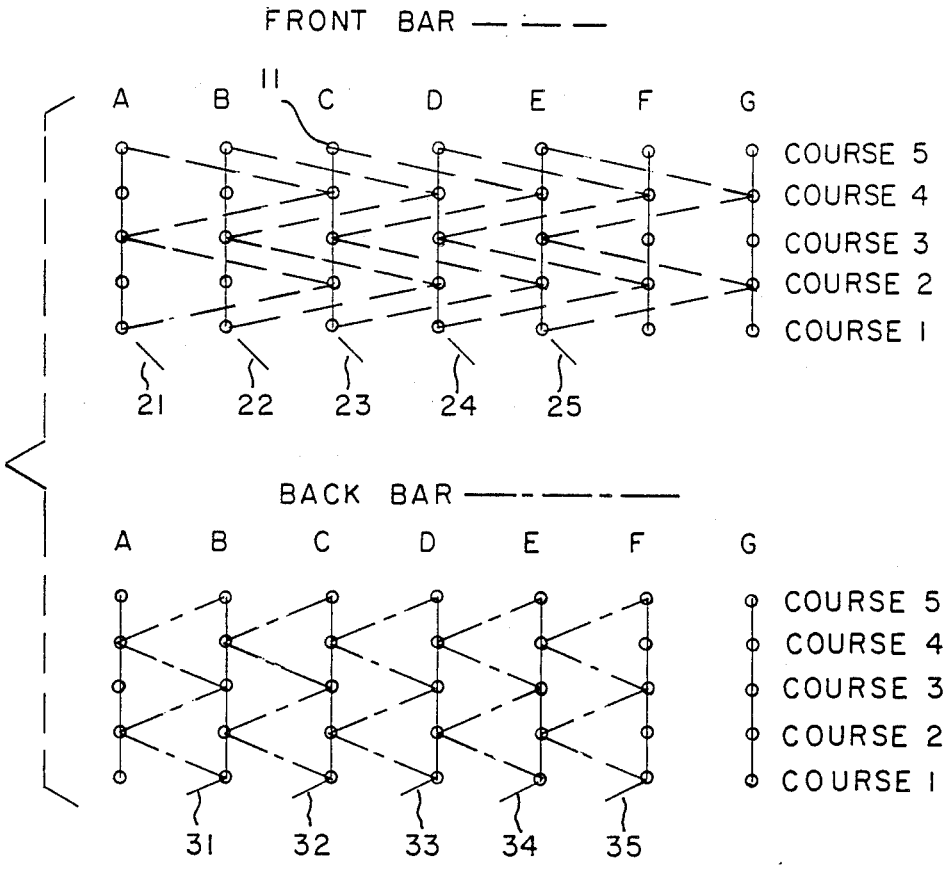
FIG. 1 is a schematic diagram of the front and back bar of a warp knit fabric of the type simulated by this invention.

A knit textile fabric as intended herein is best defined in terms of a stitch pattern as shown in FIG. 1. While many other patterns constituting warp-knitting are possible the one shown represents a jersey tricot warp knit construction. Knitting needle positions for each of five successive wales and courses for the front and back bars are represented in FIG. 1. The horizontal rows of dots represent courses 1–5 while the wales of the fabric are represented by vertical rows of dots A–G. More particularly, referring to FIG. 1 the stitch construction of the fabric is notationally set out and shows that the threads of the front bar indicated as 21–25 have back and forth movement to non-adjacent needles in successive courses and the threads of the back bar, indicated as 31–35 have similar movements.

As indicated above this technology is a tool to investigate the effects of yarn properties on the visual appearance of fabrics. The technology uses a Hewlett Packard HP9845 model 270 to print patterns which model the appearance of jersey warp knit fabrics.

Direct printing of simulations requires high resolution graphics and printing capability. The Hewlett Packard HP9845 desktop computer meets both requirements with individual pixel control of graphics on the CRT and printer. Resolution of the HP9845 printer is 77 pixels/inch in both X and Y directions. Initial experiments with various patterns showed that printing alternate rows provided sufficient resolution (38.5 rows/inch vs. 50 wales/inch in the fabric) to represent each wale in a jersey warp knit fabric. Printing alternate rows gives the printouts a subtle linearity resembling the directionality of wales in a warp knit fabric.

The first step in the method is obtaining a data set consisting of a yarn property such as denier, modification ratio, bulk, yarn shrinkage, or dyeability for each yarn in the fabric. The properties are then averaged according to the stitch pattern in the fabric to produce a wale average property for each wale in the fabric. The simulation program then produces a printout in which the print density (fraction of pixels printed) in each row is given by the equation:

$$PD = AD\,(1 + KZ) \tag{1}$$

wherein

AD is the arbitrarily selected average print density desired for the simulation (usually 0.5)

K is the contrast factor and $$Z = \frac{v - V}{V}$$

where v is the computed wale average property value for the wale being printed and V is the arithmetic mean of all the values and is calculated as follows:

$$V = \frac{(\Sigma v)}{N}$$

wherein v is the data expressed as individual values and

N is the total number of values.

Determining K (the contrast factor) for a given property requires comparison of a banded implant fabric with simulations printed at a series of K's. The K that results in the best visual match is the correct one to use.

Computer wale average property (v)

The precise location of each yarn end; for example, 21–25 in FIG. 1, in the fabric is essential for calculating wale average property (v). Experience has shown that front bar yarns are of more importance than back bar yarns in fabric uniformity because the back bar yarns in warp knit constructions are "sandwiched" in the fabric interior. When denier is the property being simulated, it has been found that front bar yarns make a 75% contribution to uniformity and back bar yarns a 25% contribution. For other properties being simulated it has been found that front bar yarns make essentially a 100% contribution to uniformity.

Referring to FIG. 1 and considering wale C in both the front and back bar it can be seen that yarn 23 appears in three odd numbered courses, e.g. 1, 3 and 5, and yarn No. 21 appears in the even numbered courses in the front bar and for the same wale in the back bar yarn 32 appears in the odd courses while yarn 33 appears in the even courses.

The weighted wale average property (in this case, denier) for wale C becomes:

$$v = \left(0.75 \times \frac{(v \text{ of yarn } 23 + v \text{ of yarn } 21)}{2} + 0.25 \times \frac{(v \text{ of yarn } 32 + v \text{ of yarn } 33)}{2}\right) \quad (2)$$

where v is the individual property value of the yarn.

Description of Flow Charts

Figure 4:
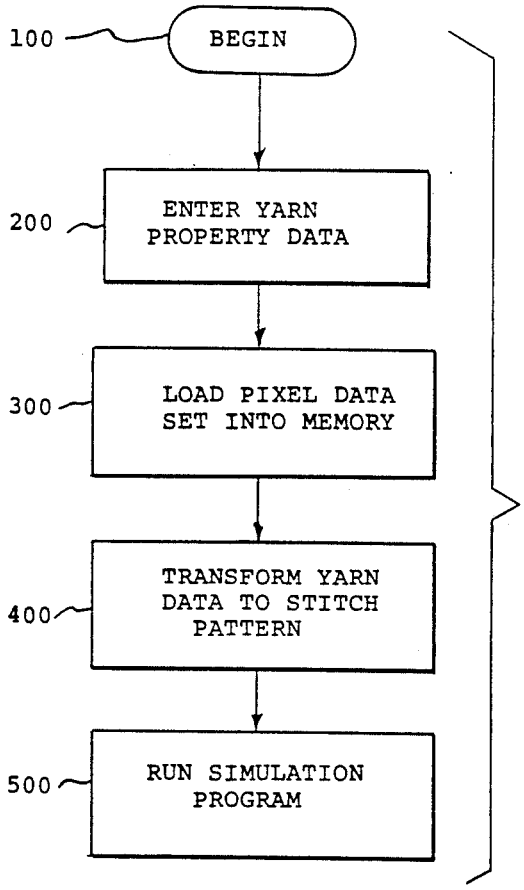
FIGS. 4–6 represent flow charts of a program to operate a computer for simulating a warp knit fabric according to the invention.
Figure 5:
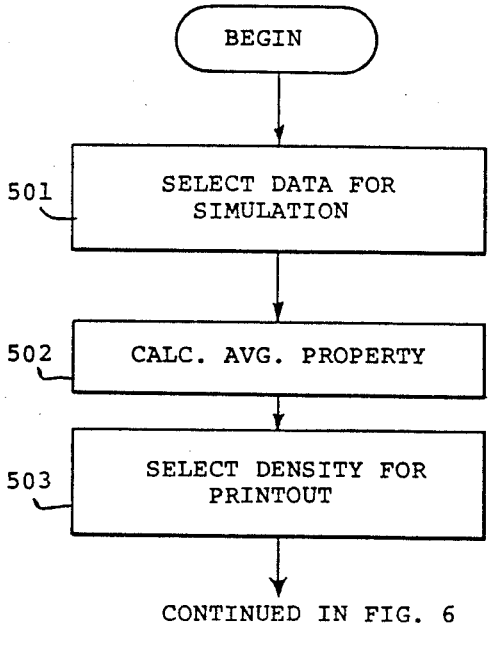
Figure 6:
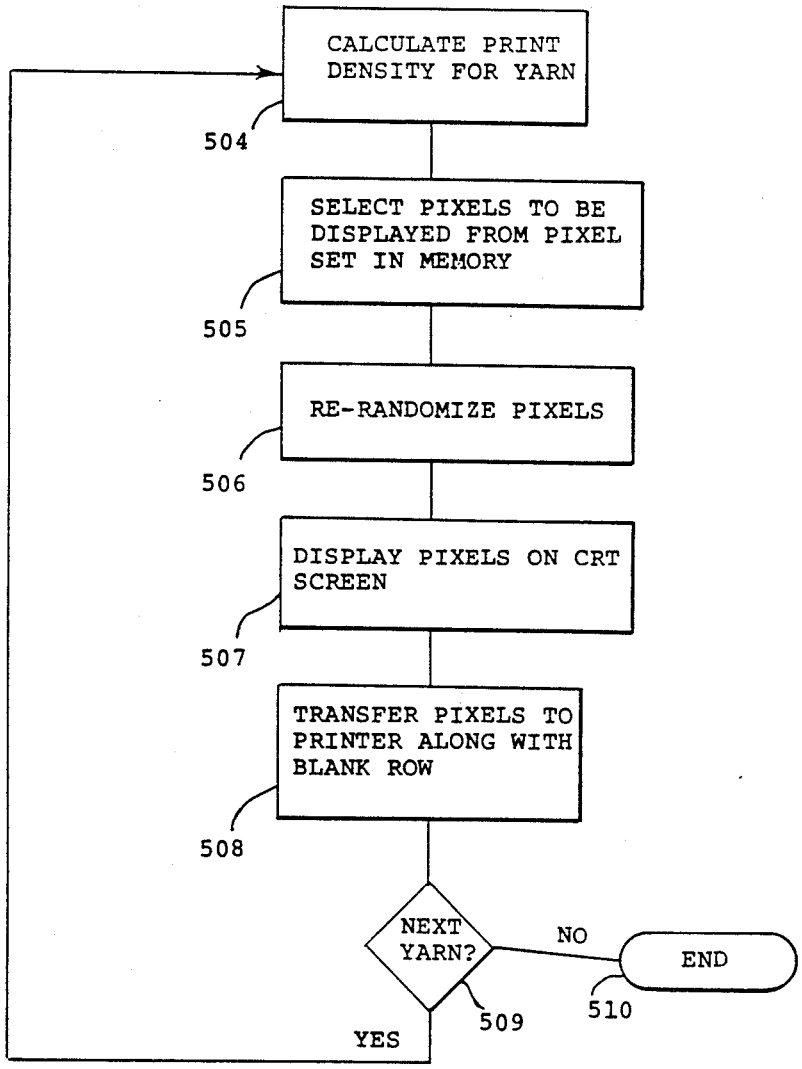

The numbers preceding each paragraph refer to the flow charts shown in FIG. 4–6.

Step 100—Running the startup program initializes the computer memory for the following steps.

Step 200—Provision is made for entering yarn property data from the keyboard or loading data previously stored on flexible disc data files. More than 1 column of data may be entered.

Step 300—A retrieval program is run to load the previously stored pixel rows into the computer memory. Pixel densities from 5% to 95% of the pixels in a graphics display row are included in the data set in steps of 1%. There are 5 rows of pseudorandomly arranged pixels at each density.

Step 400—Yarn property data are averaged according to the description on page 4 to provide wale average property data. The transform program allows keeping both the original yarn data and the wale average data in separate columns in a data matrix.

Step 500—The simulation program is loaded into memory and run.

Step 501—The operator selects the desired data to simulate (more than 1 set of data can be held in memory).

Step 502—The computer calculates the average property in the selected data for further calculations (equation on page 3, and FIG. 5).

Step 503—The operator selects the average print density desired for the simulation. Usually 0.5 is the starting level, and subsequent simulations may be run at higher or lower levels to produce darker or lighter simulations. This step does not affect the printout, unless extreme values are chosen (i.e., near the ends of the allowable scale of 0.05 to 0.95 print density). Refer to "AD" in equation (1), page 3.

Step 504—The computer calculates the print density for the first wale using equation (1), page 3.

Step 505—The pixel row data are selected corresponding to the calculated print density.

Step 506—The pixel row is re-randomized. This step is done to avoid extraneous pattern formation in the case that the same pixel density is selected more than 5 times (the number of previously generated pixel rows at each density held in memory) in succession.

Step 507—The pixel row is displayed on the graphics screen of the computer.

Step 508—The pixel row displayed on the screen is transferred to the hard copy printer along with a blank pixel row.

Step 509—The computer checks for additional yarn data, and if available, continues the process from step 504. The program terminates when all the selected data have been printed and the operator signifies that no more simulations are to be run.

The simulation of carpet fabric and woven fabrics is handled in a similar fashion. More particularly, the yarn path in a straight tufted carpet from staple yarn or bulked continuous filament yarn or a plain woven fabric is a straight line along the length of the fabric. It is therefore unnecessary to compute a wale average property for either of these cases. Yarn properties are used directly in the simulations.

Using yarn bulk property in a straight tufted carpet, yarn bulk values are entered for each yarn in the carpet fabric. Print density for each yarn is calculated according to the equation 1A (similar to equation 1).

$$PD = AD(1 + KQ) \quad (1A)$$

wherein:

AD and K are defined as in equation (1)

$Q = (p - P)/P$ p = property of the yarn being simulated

P = the average property of all the yarns in the simulation and is given by:

$P = (\Sigma p)/N$ wherein p is the data expressed as individual values and N is the number of values in the simulation.

The computer process for calculating and printing each pixel row is the same as for warp knit, except that 12 rows of pixels have been printed for each yarn to develop a printed width the same as a carpet denier yarn in the carpet sample. Also, no blank rows are printed between those rows printed to simulate the yarn.

Using yarn shrinkage property (property No. 1) and draw tension (property No. 2) in a plain woven fabric to simulate the fabric appearance in the fill direction, yarn shrinkage and draw tension values are entered for each filling yarn in the woven fabric. Print density for each yarn was calculated according to the equation 1B.

$$PD = AD(1 + K_1Q_1) + K_2Q_2 \quad (1B)$$

wherein:

AD and K are defined as in equation (1)

$Q_1 = (p_1 - P_1)/P_1$ $p_1$ = property No. 1 of the yarn being simulated $P_1$ = the average property No. 1 of all the yarns in the simulation and is given by:

$P_1 = (\Sigma p_1)/N$ wherein $p_1$ is the data expressed as individual values and N is the number of values in the simulation.

The above is repeated for $Q_2$, with $P_2$ and $P_2$.

This equation is similar to equation (1) but based on the combined effects of two variables. One (1) row of pixels and one (1) blank row was printed for each yarn. Because a plain woven fabric is symmetrical in warp and fill directions, a similar procedure using properties of the warp yarns would simulate the appearance of the fabric in the warp direction.

TEST METHODS

The test methods for determining bulk, yarn denier, dyeability, modification ratio and shrinkage are detailed below: Bulk Bulk is the amount a boiled-off, conditioned yarn sample extends under a 0.10-gram/denier tension, expressed as percent of the sample length without tension. A boiled-off, dried, and conditioned specimen of yarn is used. If the specimen appears to be entangled or not straight, the specimen is held at one end and gently shaken prior to proceeding with the measurement. A 50-cm length ($L_1$) of specimen in a relazed condition (i.e., with no tension) is then mounted in a vertical position. The specimen is then extended by gently hanging a weight on the yarn to produce a tension of $0.10 \pm 0.02$ gram/denier. The extended length ($L_2$) is read after the tension has been applied for at least three minutes. Bundle crimp elongaton, in percent, is then calculated as $100(L_2 - L_1)/L_1$. Results reported herein are averages of three tests per sample.

Yarn Denier

Yarn denier is measured by removing the yarn from a package and slowly winding it on an 18 cm. long piece of cardboard with negligible tension. The yarn is aged at ambient room conditions for at least one week and then conditioned just prior to denier measurement. For the measurement, the sample is removed from the card, suspended on a vertical 90 cm. long cutter, loaded with a specified weight for at least three minutes for yarns having a denier no greater than 1900, and for at least six minutes for yarns having a denier above 1900, and then a 90 cm. length of yarn is cut. The specified weights are: 62 grams for yarns of greater than 1,000 denier, 125 grams for yarns of greater than 1,000 and up to 2,000 denier, and 280 grams for yarns of greater than 2,000 denier. The cut sample is then weifhed on an analytical balance. The weight of the sample in grams measured to 4 significant figures is multiplied by 1,000 to give the denier of the sample. Normally denier is given as the average of three such measurements.

MBB Dyeability

For MBB dye testing yarn samples are prepared by loosely winding 3.00 gram skeins. Thirty-six of these skeins, consisting of 6 control samples and 30 test samples, are scoured by immersing them in a vessel containing 21 liters of room temperature scouring solution comprised of 160 ml ammonium hydroxide, 100 ml 10% Merpol HCS, (a liquid, non-ionic detergent from E. I. du Pont de Nemours and Co.), with the remainder of the solution being demineralized water. This bath has a pH of 10.4. The bath containing the yarn samples is heated to 95° C. at the rate of 3° per minute. The samples are removed and the bath discarded when the temperature reaches 95° C.

The yarns are then dyed by placing the 36 samples in 21 liters of an aqueous dye solution comprised of 200 ml of a standard buffer solution at 3.8 pH, 100 ml of 10% Merpol HCS (a liquid, nonionic detergent from E. I. du Pont de Nemours and Co.), and 500 ml of 0.18% Anthraquinone Milling Blue BL (abbreviated MBB) (C.I. Acid Blue 122). The final bath pH is 4.4. The solution temperature is increased at 3°/min from room temperature to 75° C., and held at that temperature for 30 minutes. The dyed samples are rinsed, dried, and measured for dye depth by reflecting colorimeter.

The dye values are determined by computing K/S values from reflectance readings. The equations are:

$$MBB \text{ dyeability} = \frac{K/S \text{ sample}}{K/S \text{ control}} \times 180 \text{ and } K/S = \frac{(1-R)^2}{2R}$$

when R = the reflectance value. The 180 value is used to adjust and normalize the control sample dyeability to a known base.

Modification Ratio

Modification Ratio is used to describe the cross-sectional configuration of a fiber having a non-round cross-section. It is the ratio of a circumscribed circle to an inscribed circle as described in U.S. Pat. No. 2,939,201; col. 1, line 60, to col. 4, line 38, which is incorporated herein by reference.

Shrinkage

Shrinkage is the change in extended length of yarn or fiber which occurs when the yarn or fiber is treated in a relaxed condition in boiling water at 100° C. to determine continuous filament yarn shrinkage, a piece of conditioned yarn sample is tied to form a loop of between 65 and 75 cm length. The loop is hung on a hook on a meter board and a 125-gram weight is suspended from the other end of the loop. The length of the loop is measured to give the before boil-off length ($L_1$). The weight is then removed from the loop. The sample is loosely wrapped in an open-weave cloth (e.g., cheesecloth), placed in 100° C. boiling water for 20 minutes, removed from the water, centrifuged, removed from the cloth and allowed to hang-dry at room conditions prior to undergoing the usual conditioning before further measurement. The dried, conditioned loop is then rehung on the meter board, the 125-gram weight is replaced, and the length of the loop measured as before to give the after boil-off length ($L_2$). The yarn shrinkage, expressed as a percent, is then calculated as $100(L_1 - L_2)/L_1$, and as reported herein is the average of three such measurements for a given yarn.

EXAMPLE I

Figure 2:
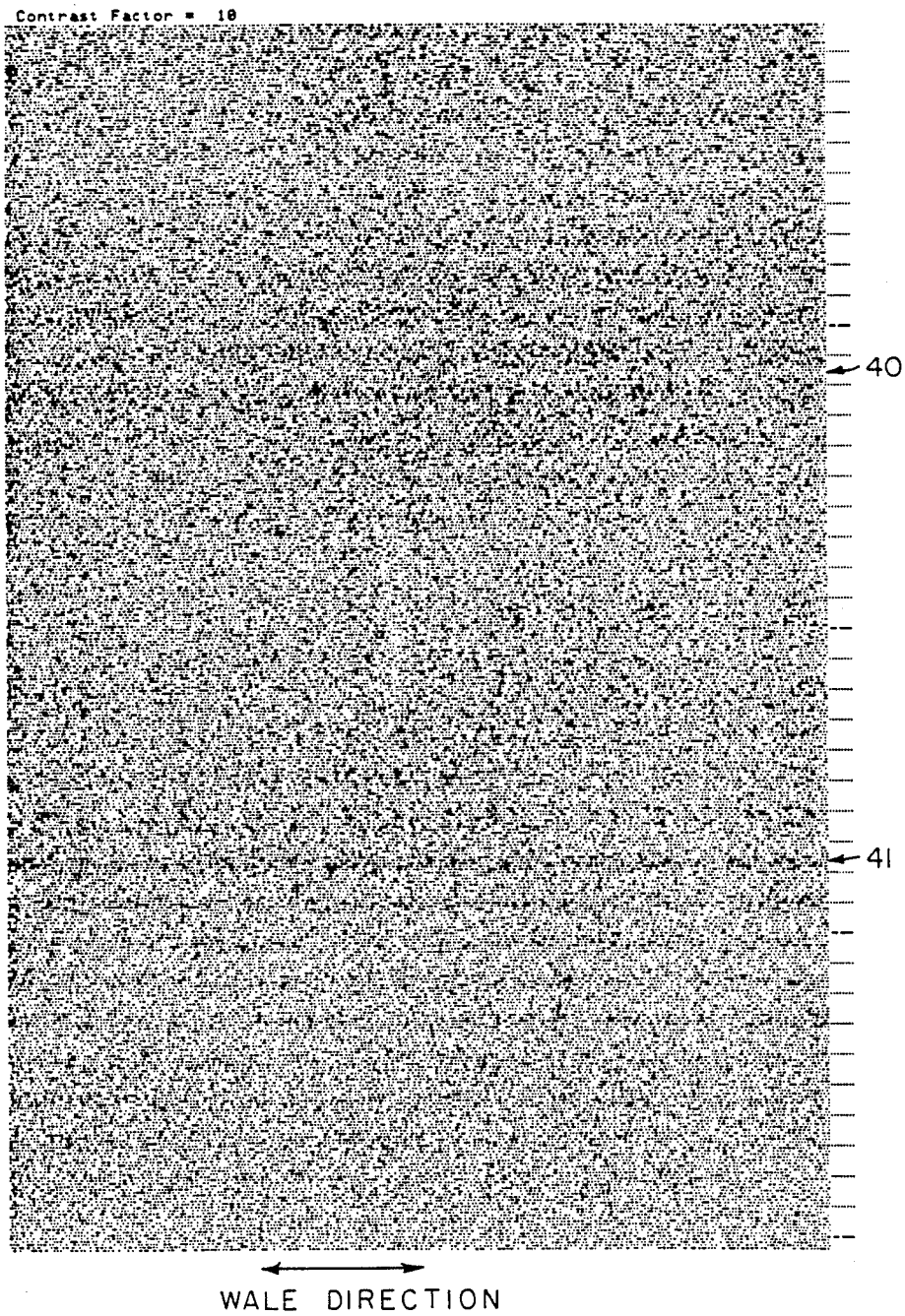
FIG. 2 is a drawing of a graphics display of a warp knit fabric simulated according to the invention.

In an example using nominal 40 denier yarn in the jersey tricot warp knit construction represented in FIG. 1 wale average deniers are calculated according to equation 2 for each wale in the fabric and the pixel density is calculated according to equation 1. The pixel density is displayed in a series of rows to represent each wale in the fabric as shown in FIG. 2 wherein the simulation of the fabric displaying streaks at locations 40 and 41 closely resembles a fabric knit of the actual yarns whose properties were used for the simulation. The simulation was prepared on a Hewlett Packard HP9845 having a thermal printer programmed according to the flow charts shown in FIG. 4.

Figure 3:
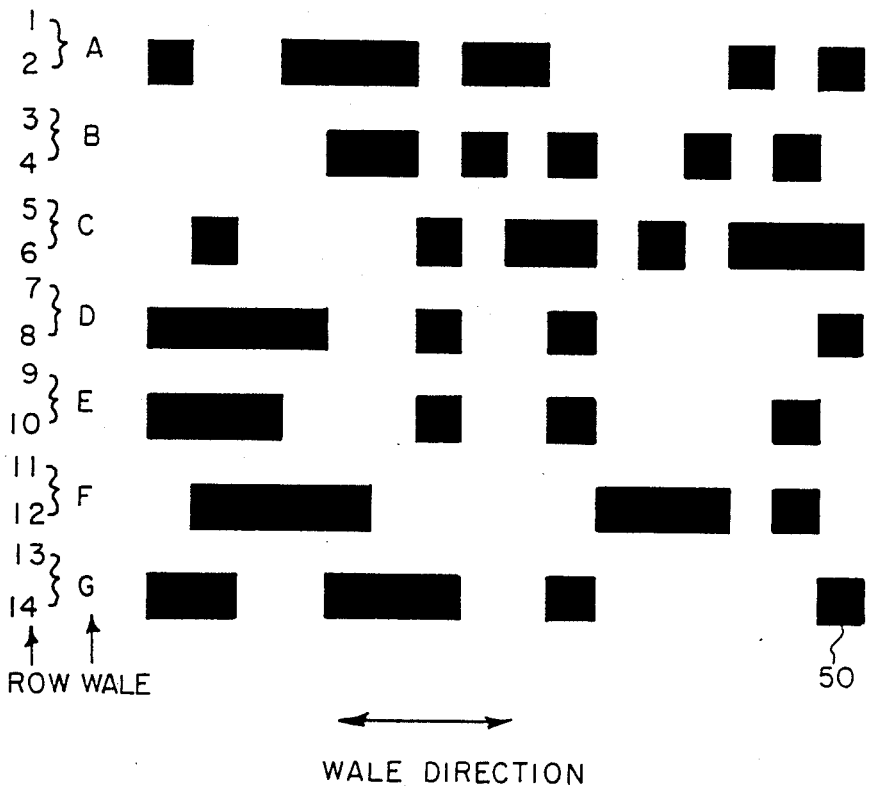
FIG. 3 is an enlarged representation of a portion of a warp knit fabric simulated according to the invention.

An enlarged portion of FIG. 2 is shown in FIG. 3 wherein alternate rows are printed to give subtle linearity and one pixel is represented by a square as designated at 50.

EXAMPLE II

Figure 7:
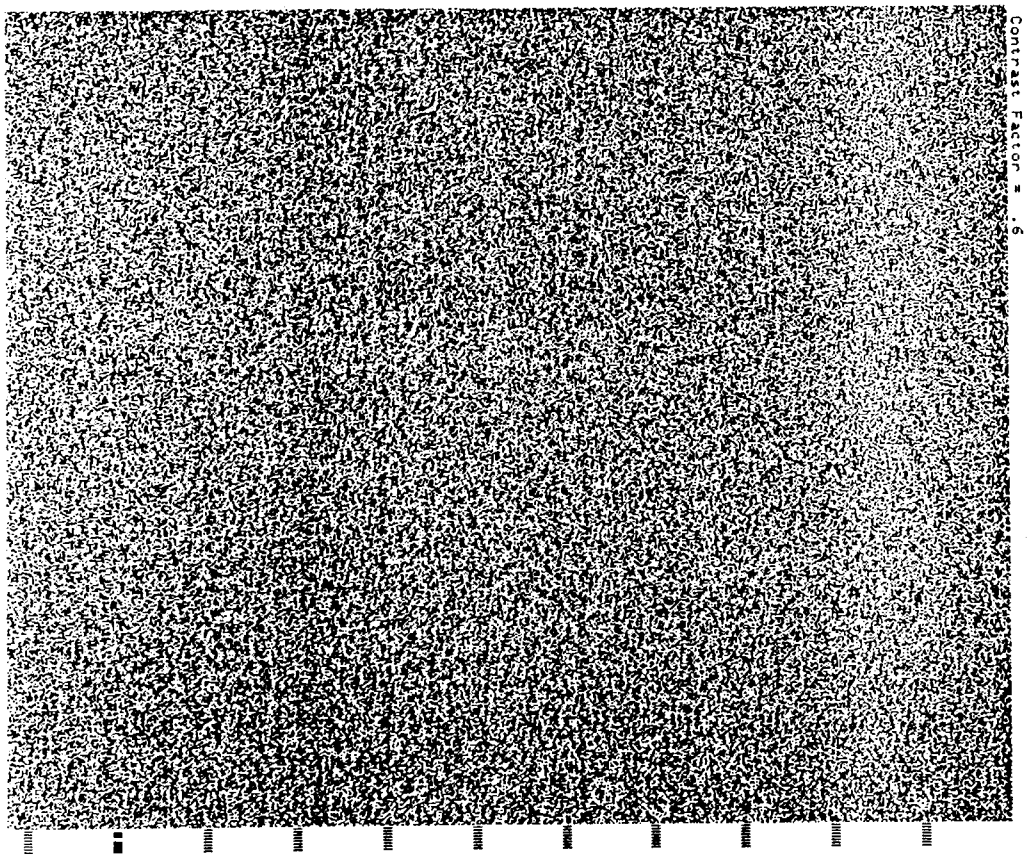
FIG. 7 is a drawing of a graphics display of a carpet fabric simulated according to the invention.

In an example using a 1200 denier yarn in a straight tufted carpet fabric construction, fabric appearance is simulated in the fabric. Bulk values were entered for each yarn in the carpet fabric. Print Density (PD) is calculated according to equation 1A. The print density is displayed by printing 12 rows of pixels for each yarn as shown in FIG. 7 which closely resembles the carpet fabric tufted of the actual yarns whose properties were used for the simulation.

EXAMPLE III

Figure 8:
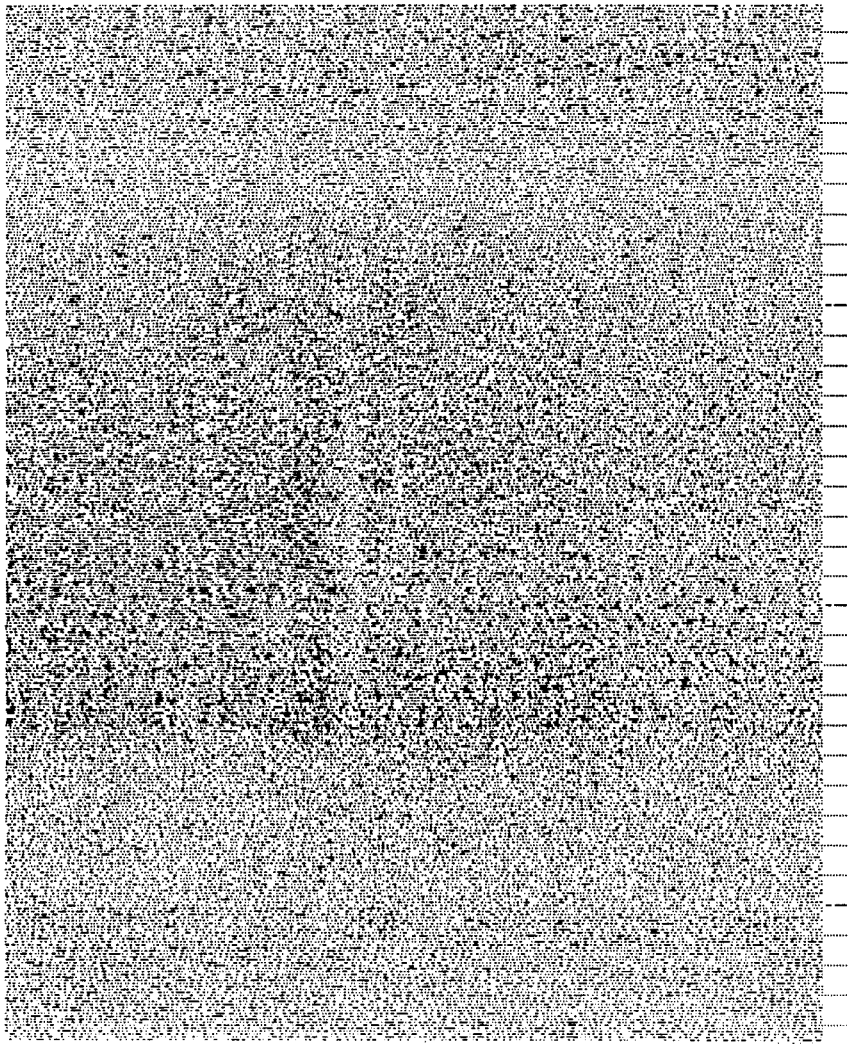
FIG. 8 is a drawing of a graphics display of a woven fabric simulated according to the invention.

In an example using a 70 denier yarn in a plain woven fabric construction fabric appearance is simulated in the fill direction. Print Density (PD) is calculated for each yarn in the fill direction according to equation 1B using yarn shrinkage values. The pixel density is displayed in a series of rows to represent each fill yarn as shown in FIG. 8 which closely resembles the fabric woven of the actual yarns whose properties were used for the simulation.

We claim:

1. A computer-aided method of simulating and displaying wanted or unwanted gray scale patterning independent of color due to variation in physical or chemical properties of a yarn used for knitting a warp knot fabric, said fabric having a stitch pattern with courses and wales and each of said yarn properties having a constant factor, said method comprising the steps of:

selecting a data set of at least one yarn physical property and the contrast factor for said yarn physical property for each yarn in the warp knit fabric;

providing a computer with a data base that includes the yarn physical property and the contrast factor for said yarn physical property for each yarn in the warp knit fabric;

averaging said yarn physical property according to said stitch pattern to produce a wale average property for each wale in said fabric;

calculating print density from said wale average properties and said contrast factor; and displaying said print density as a display element to represent each wale in said warp knit fabric whereby a simulation of the fabric appearance made from said yarns is obtained by knowing said yarn physical property and said contrast factor for each yarn in the warp knit fabric.

2. A computer-aided method of simulating and displaying wanted or unwanted gray scale patterning independent of color due to variation in physical or chemical properties of a yarn used for weaving fabric, said fabric having a pattern of warp and fill yarns and each of said yarn properties having a contrast factor, said method comprising the steps of:

selecting a data set of at least one yarn physical property and the contrast factor for said yarn physical property for each yarn in the warp or fill of said fabric;

providing a computer with a data base that includes the yarn physical property and the contrast factor for said yarn physical property;

averaging said yarn physical property according to said stitch pattern to produce and average property for said warp of rill yarn in said fabric;

calculating print density form said warp of fill yarn average properties and said contrast factor; and displaying said print density as a display element to represent each warp or fill yarn in said woven fabric whereby a simulation of the fabric appearance made from said yarns is obtained by knowing said yarn physical property and said contrast factor for each warp and fill yarn in the fabric.

3. A computer-aided method of predicting and displaying wanted or unwanted gray scale patterning independent of color due to variation in physical or chemical properties of a yarn used for tufting a carpet fabric, each of said yarn properties having a contrast factor, said method comprising the steps of:

selecting a data set of at least one yarn physical property and the contrast factor for said yarn physical property for each yarn in the carpet fabric;

providing a computer with a data base that includes the selected yarn physical property and the contrast factor for said yarn physical property for each yarn in the carpet fabric;

averaging said yarn physical properties for each yarn in said carpet fabric;

calculating print density from said average properties and said contrast factor; and displaying said print density as a display element to represent each yarn in said carpet fabric whereby a simulation of the carpet fabric appearance made from said yarns is obtained by knowing said yarn physical property and said contrast factor for each yarn in the carpet fabric.

* * * * *